US005943900A

United States Patent [19]

Bakermans

[11] Patent Number: 5,943,900

[45] Date of Patent: Aug. 31, 1999

[54] DIE SET FOR A STAMPING AND FORMING MACHINE

[75] Inventor: Johannes Cornelis Welhelms Bakermans, Harrisburg, Pa.

[73] Assignee: The Whitaker Corporation, Wilmington, Del.

[21] Appl. No.: 08/987,805

[22] Filed: Dec. 11, 1997

[51] Int. Cl.[6] ..... B21D 37/10

[52] U.S. Cl. ..... 72/408; 72/456

[58] Field of Search ..... 72/456, 408, 450, 72/407; 411/433, 385, 354, 383

[56] References Cited

U.S. PATENT DOCUMENTS

| | | | |
|---|---|---|---|
| 1,305,009 | 5/1919 | Robertson | 285/89 |
| 2,377,581 | 6/1945 | Shaffrey | 411/433 |
| 3,080,778 | 3/1963 | Alcorn, Jr. | 72/456 |
| 3,159,075 | 12/1964 | Bjork | 411/65 |
| 3,427,851 | 2/1969 | Michelson | 72/408 |
| 4,028,925 | 6/1977 | Mainiero | 72/294 |
| 4,321,819 | 3/1982 | Kraft et al. | 72/456 |
| 4,975,014 | 12/1990 | Rufin et al. | 411/385 |
| 5,138,862 | 8/1992 | Chasteen et al. | 72/347 |
| 5,373,765 | 12/1994 | Asano et al. | 83/623 |
| 5,410,928 | 5/1995 | Bakermans et al. | 83/155 |
| 5,718,145 | 2/1998 | Grabbe | 72/456 |
| 5,803,671 | 9/1998 | Gray | 405/259.1 |

*Primary Examiner*—Joseph J. Hail, III
*Assistant Examiner*—Susan R. Kingsbury
*Attorney, Agent, or Firm*—M. K. VanAtten

[57] ABSTRACT

A die set (24) for use with a stamping and forming machine (10) includes two opposed tooling plates (50, 52) arranged to undergo reciprocating motion with respect to a base plate (40) toward and away from a strip of material (30) that is fed along a feed path (38) between the two tooling plates (50, 52). Each tooling plate has a tool attachment surface (58, 60) facing inwardly toward the feed path (38) for the attachment of punch and die tooling assemblies (26, 28) for performing the stamping and forming operations on the strip of material. Each of the tooling plates (50, 52) includes four guide posts (82) that extend outwardly in a direction away from the feed path (38) so that the area (98) between the opposing tool attachment surfaces (58, 60) is maintained clear for the operation and maintenance of the punch and die tooling assemblies (26, 28).

29 Claims, 6 Drawing Sheets

DIE SET FOR A STAMPING AND FORMING MACHINE

The present invention relates to a die set having mutually facing mounting surfaces for receiving mating die and punch assemblies for use in a stamping and forming machine and more particularly to such a die set having guide posts that do not extend between these facing mounting surfaces.

BACKGROUND OF THE INVENTION

Conventional stamping and forming machines, in certain cases, utilize a die set consisting of a lower plate having two or four spaced apart guide posts extending upwardly and an upper plate having bushings fixed therein that slidingly engage the posts. The posts and bushings maintain alignment and squareness between the two plates when the plates are moved toward and away from each other. The lower plate is usually attached to the platen of a press and the upper plate is usually attached to the press ram. A die assembly is attached to a mounting surface of the lower plate and a mating punch assembly is attached to and carried by a mounting surface of the upper plate. Since the guide posts extend between the upper and lower plates, they sometimes interfere with or limit access to the punch and die assemblies attached to these facing mounting surfaces. To avoid this problem and provide adequate room for easy access, the guide posts must be spaced further apart, necessitating substantially larger die sets than would otherwise be required.

In universal stamping and forming machines, those having two mutually opposed ram levers, such as the machine disclosed in U.S. Pat. No. 5,410,928 which issued May 2, 1995 to Bakermans, et al. and is incorporated herein by reference, the mating punch and die assembly is in the form of a box structure. That is, an outer guide structure having four walls, in the shape of a box with two opposite open ends, contains the punch assembly in one end and the die assembly in the other end. The four walls then guide the punch and die assemblies in their reciprocating motion toward and away from each other. In this case, access to the punch and die assemblies is even more limited because they are surrounded by the box structure.

What is need in both of these cases is a die set for receiving the mating punch and die assemblies having no substantial intervening structure that would limit easy access.

SUMMARY OF THE INVENTION

A die set is disclosed for use in a stamping and forming machine having a ram arranged to undergo reciprocating motion. The die set includes a base plate having a major mounting surface and a tooling plate for receiving and carrying stamping and forming tooling. A first coupling is provided for coupling the tooling plate to the major mounting surface so that the tooling plate is free to undergo reciprocating movement in forward and reverse directions parallel to the major mounting surface while the tooling plate is spaced from the major mounting surface. A second coupling is arranged to couple the ram to the tooling plate so that the ram imparts reciprocating movement to the tooling plate. The tooling plate includes a tool attachment surface for attaching stamping and forming tooling thereto. The coupling includes at least two guide members attached to and extending from opposite ends of the tooling plate from a side opposite the tool attachment surface. A linear bearing is attached to the major mounting surface for each of the guide members. Each guide member is in sliding engagement with a respective one of the linear bearings for permitting reciprocating movement in a direction parallel to the major mounting surface.

DESCRIPTION OF THE PREFERRED EMBODIMENT

Figure 1:
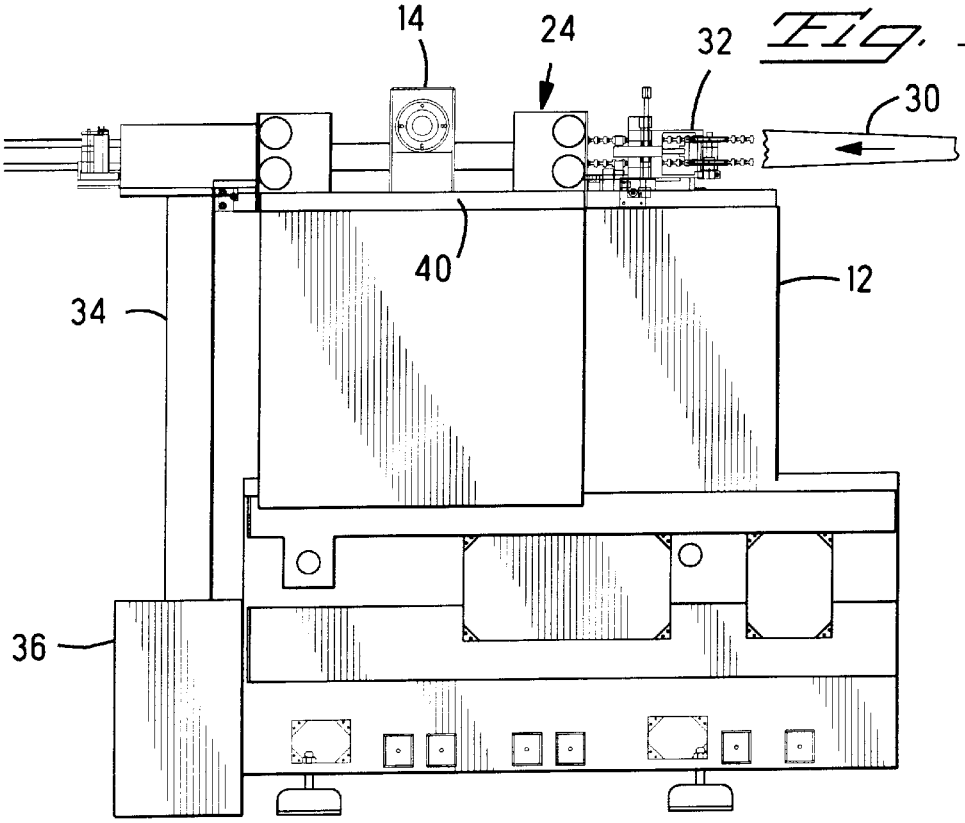
FIGS. 1, 2, and 3 are front, plan, and side views of a stamping and forming machine incorporating the teachings of the present invention.
Figure 2:
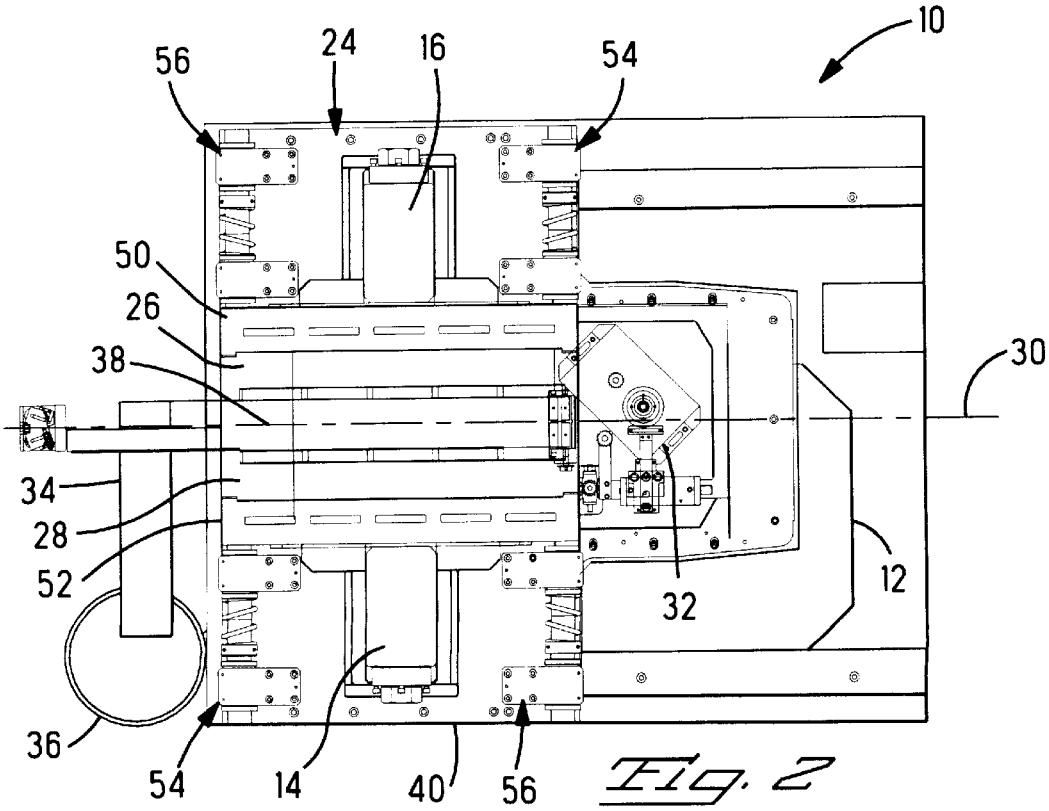
Figure 3:
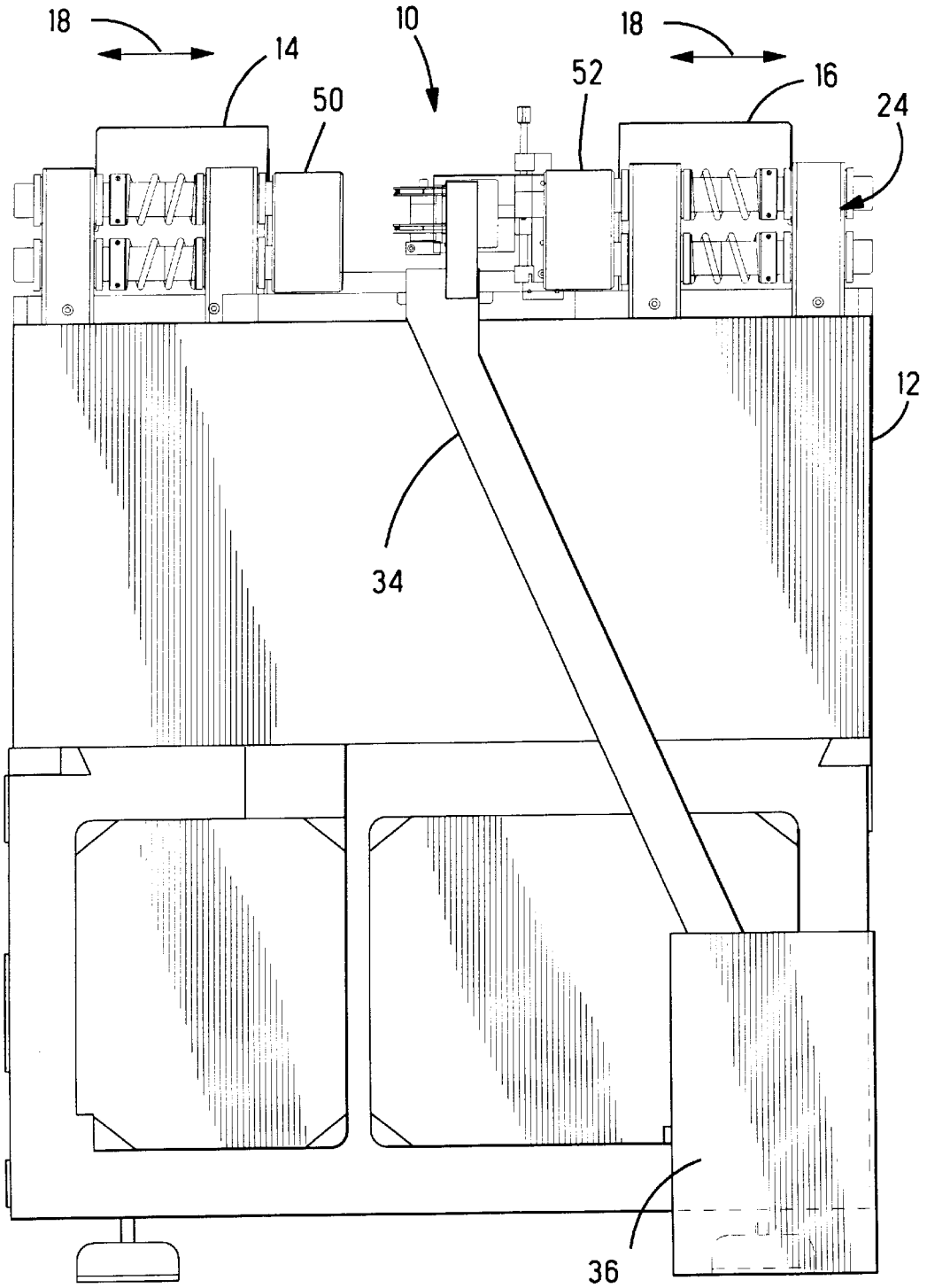

There is shown in FIGS. 1, 2, and 3, a stamping and forming machine 10 having a frame 12, and first and second opposed pivoting levers 14 and 16 which undergo pivoting motion so that their ends alternately move toward and away from each other in the directions of the arrows 18, as shown in FIG. 3. This type of stamping and forming machine is described more fully in the above referenced '928 patent and, therefore, need not be further described here. The machine 10 includes a die set 24 for holding and operating mating punch and die assemblies, 26 and 28 respectively, for performing stamping and forming operations on a strip 30 of material in the manufacture of electrical contacts and other stamped and formed parts. A feed unit 32, attached to the frame 12, feeds the strip 30 into the area between the punch and die assemblies along a feed path 38 intermittently in timed relation to the operation of the machine. A scrap collection system 34 is arranged to collect bits and pieces of material left over from the stamping and forming operations and direct this material to a scrap barrel 36, in the usual manner.

Figure 4:
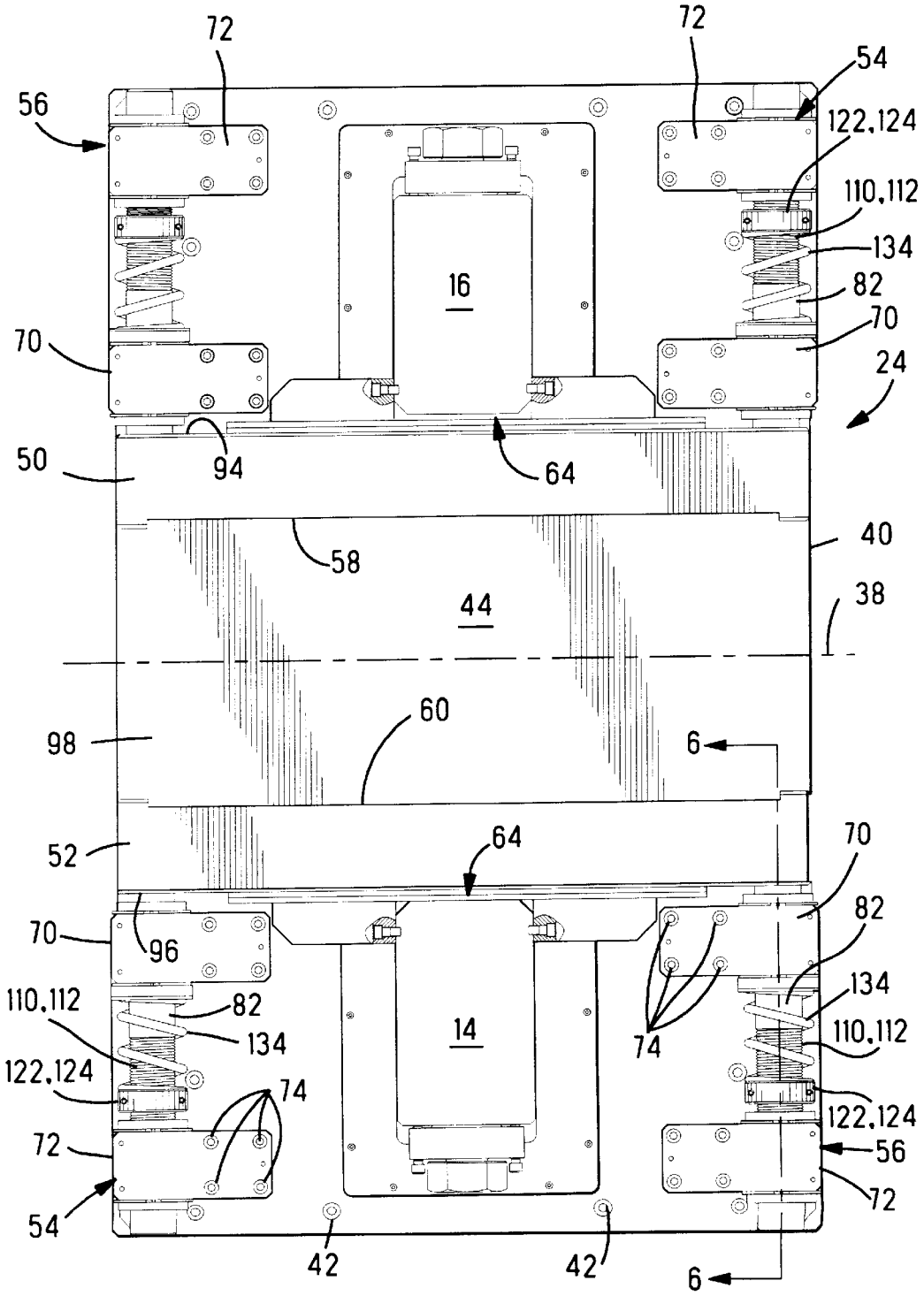
FIG. 4 is an enlarged plan view of the die set shown in FIG. 2.
Figure 5:
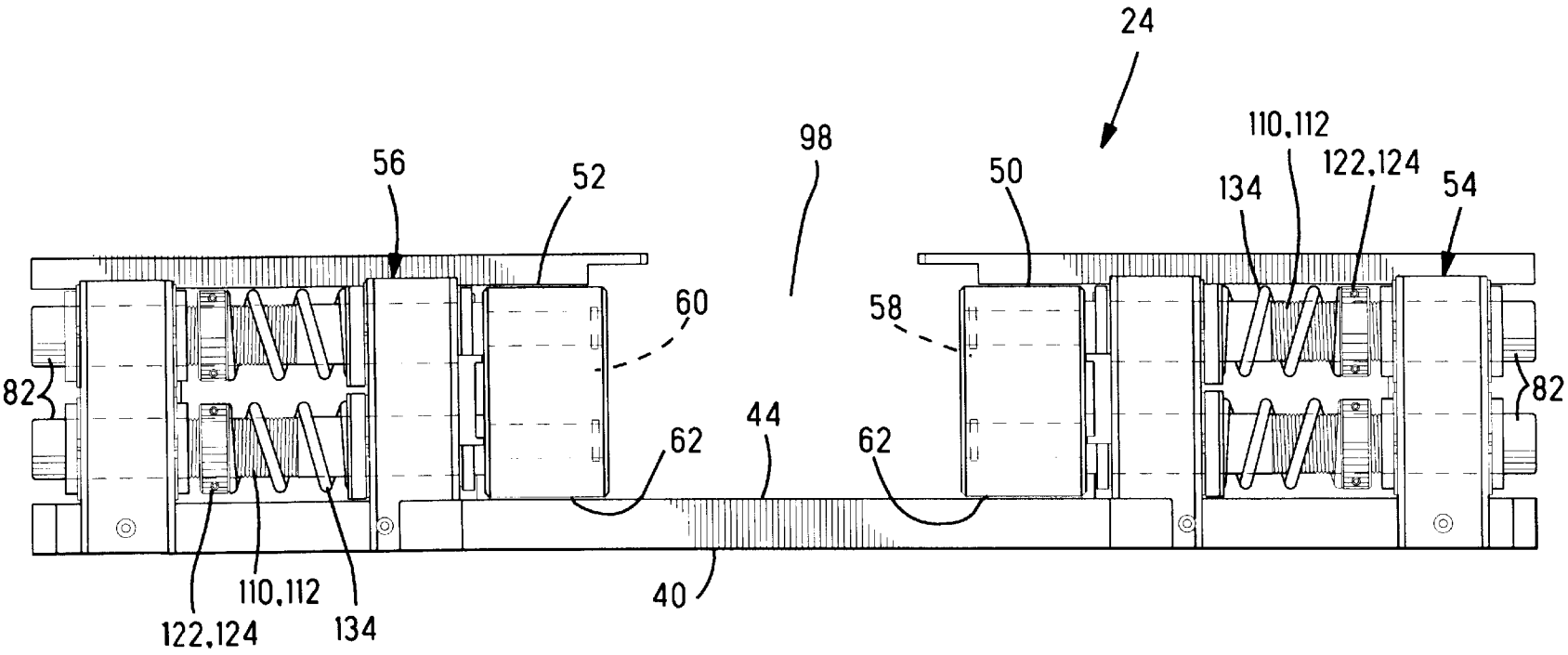
FIG. 5 is a side view of the die set shown in FIG. 4.

As shown in FIGS. 4 and 5, the die set 24 includes a base plate 40 secured to the frame 12 by means of screws 42 that extend into threaded holes in the frame. The base plate 40 includes an upwardly facing major mounting surface 44. First and second tooling plates 50 and 52 are disposed on opposite sides of the feed path 38, as best seen in FIG. 4, and are coupled to the major mounting surface 44 by means of first and second couplings 54 and 56 which are similar but are mirror images of each other. The first and second tooling plates have mutually opposed tool attachment surfaces 58 and 60 for attaching stamping and forming tooling thereto. The first and second couplings 54 and 56 allow the tooling plates to undergo reciprocating movement in a forward direction toward the feed path 38 and in a reverse direction parallel to the major mounting surface. The tooling plates 50 and 52 are completely guided in their movement and supported by their respective first and second couplings 54 and 56, the tooling plates being spaced from the major mounting surface 44 by a small amount as indicated at 62 in FIGS. 5 and 6. A drive coupling 64 couples each of the levers 14 and 16 to its respective tooling plate 52 and 50. The drive couplings are arranged to accommodate the pivoting motion of the levers 14 and 16 while imparting linear movement to the tooling plates 52 and 50.

Figure 6:
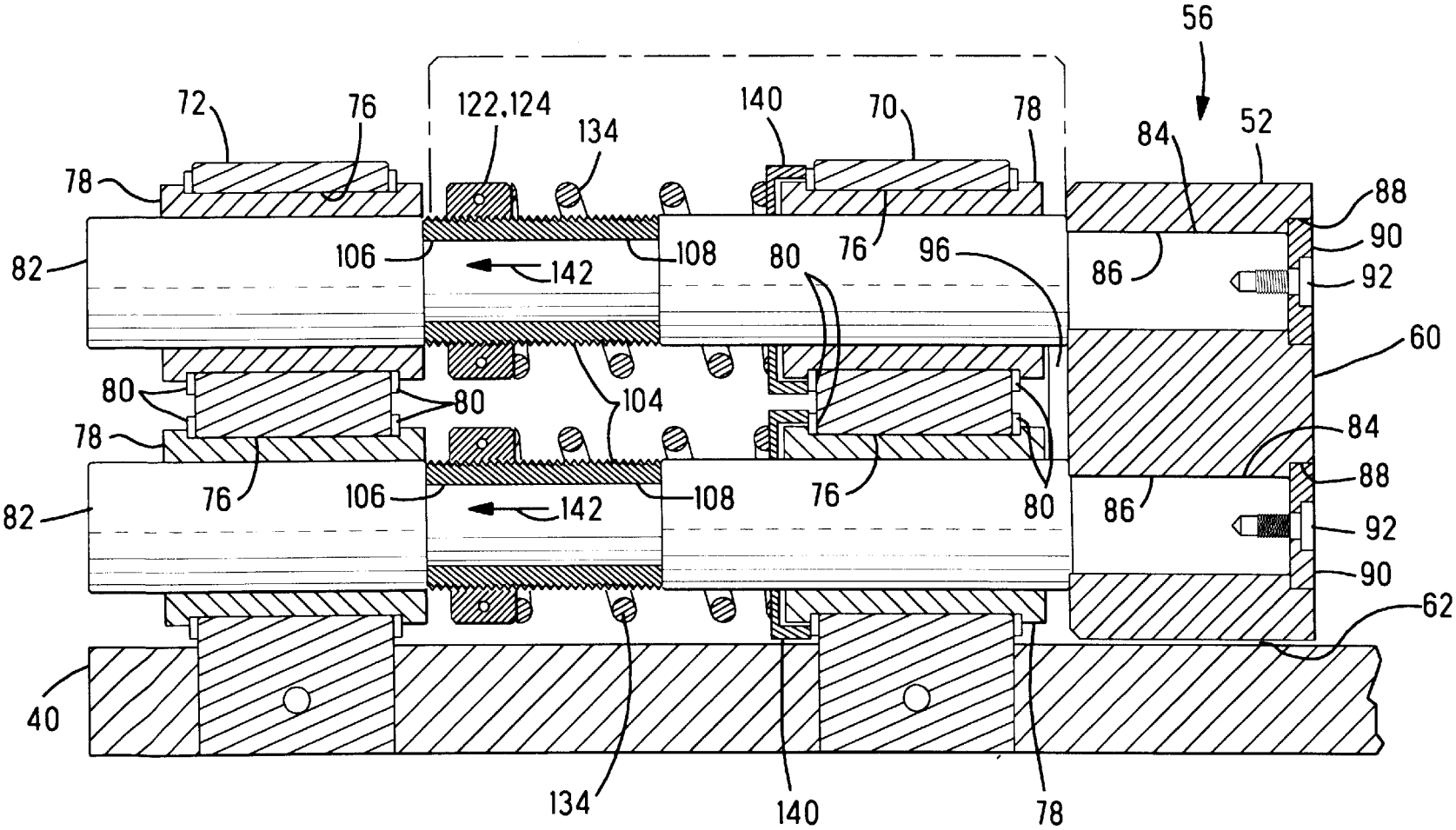
FIG. 6 is a cross-sectional view taken along the lines 6—6 in FIG. 4.

Each of the first and second couplings 54 and 56, as shown in FIGS. 5 and 6, includes inner and outer spaced apart support blocks 70 and 72 attached to the major mounting surface 40 by means of screws 74 that extend through holes in the support blocks and into threaded holes in the base plate 40. Each of the support blocks 70 and 72 have two vertically positioned bores 76 formed therethrough so that each bore in one block is in alignment with another bore in the other block. A linear ball bearing 78 is disposed in each bore 76 and is retained in place by means of two retaining rings 80 arranged in grooves in the outer diameter of the bearing, as best seen in FIG. 6. A guide member or post 82 extends through each pair of aligned linear ball bearings 78 as shown in FIG. 6. Each guide post 82 has a reduced diameter 84 that is a slip fit with a respective bore 86 in its respective tooling plate 50 and 52. Each bore 86 includes a counterbore 88 in the tool attachment surface, 58 and 60, for receipt of a clamping disc 90. A screw 92 extends through a hole in the clamping disc and into a threaded hole formed axially in the end of the reduced diameter 84 and tightly secures the guide post to the tooling plate. The guide posts 82 extend outwardly from their respective tooling plates 50 and 52 from sides 94 and 96 that are opposite the tool attachment surfaces 58 and 60, respectively, for a purpose that will be explained below.

Figure 7:
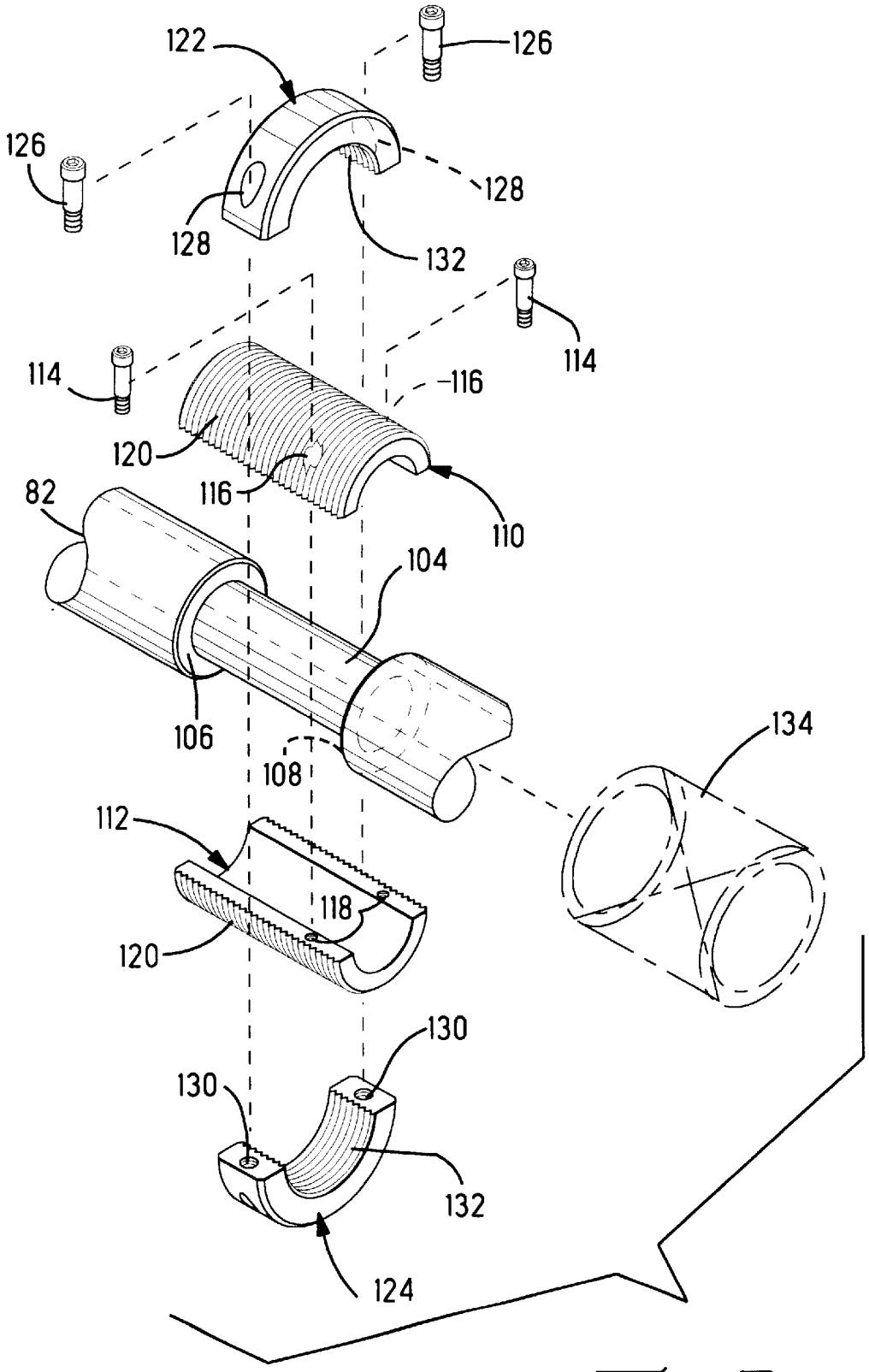
FIG. 7 is an exploded parts view of a portion of one of the couplings shown in FIG. 6.

As best seen in FIGS. 6 and 7 each of the guide posts 82 included a reduced diameter 104 in the area between the inner and outer support blocks 70 and 72, having a length limited by two shoulders 106 and 108. Two mating screw thread halves 110 and 112 are arranged to closely fit around the reduced diameter 104 and are held together by means of screws 114 that extend through clearance holes 116 in the half 110 and into threaded holes 118 in the half 112. The length of the screw thread halves is chosen to fit snugly between the shoulders 106 and 108. A screw thread 120 is formed on the outer diameter of the mated screw thread halves 110 and 112 for receiving a nut composed of two nut halves 122 and 124. The nut halves are held together by means of screws 126 that extend through clearance holes 128 formed in the nut half 122 and into threaded holes 130 formed in the nut half 124. An internal screw thread 132 is formed in the inside diameter of the mated nut halves 122 and 124 that mates with the screw thread 120. A relatively heavy compression spring 134 is disposed around the guide post between the mated nut halves and the inner support block 70, as best seen in FIG. 6. A counterbored cap 140 is disposed between the end of the spring 134 and the retaining ring 80 so that all axial directed forces from the heavy spring 134 are transmitted directly to the inner support block 70 rather than through the linear ball bearing 78 which would subject the retaining ring 80 to substantial shearing forces. The mated nut halves 122 and 124 and the screw thread 120 serve as an adjustable coupling between the end of the spring 134 and the guide post 82. By rotating the mating nut halves 122 and 124, the spring 134 can be compressed or allowed to extend thereby altering the amount of force exerted on the guide posts 82 urging them in the direction of the arrows 142. The length of the springs 134 is chosen so that, once the nut is adjusted, there is sufficient room for compression to allow adequate movement of the tooling plates 50 and 52 toward the feed path 38 during operation of the machine. The spring force is adjusted so that the tooling plates 50 and 52 are returned to their retracted positions, shown in FIGS. 4 and 5, when the levers 14 and 16 are pivoted away from the feed path 38. Further, certain machine vibrations may be dampened somewhat by adjusting each individual spring force to optimize its dampening effect.

The guide posts 82 extend outwardly from the tooling plates 50 and 52 from the sides 94 and 96 that are opposite the tool attachment surfaces 58 and 60, respectively. Importantly, with this structure, the guide posts 82 do not extend into the space 98 between the opposing tool attachment surfaces 58 and 60, as best seen in FIG. 5. By keeping this space and surrounding space clear of the first and second couplings 54 and 56 and their guide posts 82, the space 98 can more efficiently and easily be utilized for operation and maintenance of the punch and die assemblies 26 and 28.

While the die set 24 is described above as having four guide posts 82 for each of the first and second tooling plates 50 and 52, it will be appreciated that fewer or more guide posts may be utilized in the practice of the present invention. Further, while the two screw thread halves 110 and 112 and the two nut halves 122 and 124 provide economies in the manufacture of the die set 24, the screw threads 120 may be formed in the outer diameter of the guide post 82 instead of utilizing the separate screw thread halves 110 and 112 and the nut halves 122 and 124 may be made as a single unitary piece.

An important advantage of the present invention is that the space between and around the first and second tooling plates of the die set remains unobstructed by the guide posts.

I claim:

1. A die set for use in a stamping and forming machine having a ram arranged to undergo reciprocating motion, said die set comprising:

(1) a base plate having a major mounting surface;

(2) a tooling plate for receiving and carrying stamping and forming tooling;

(3) a first coupling for coupling said tooling plate to said major mounting surface so that said tooling plate is free to undergo reciprocating movement in forward and reverse directions parallel to said major mounting surface and spaced therefrom, said first coupling including at least two guide members attached to and extending from opposite ends of said tooling plate from a side of said tooling plate opposite said tool attachment surface; and (4) a drive coupling, separate from said first coupling, arranged to couple said ram to said tooling plate between said at least two guide members so that said ram imparts said reciprocating movement to said tooling plate.

2. The die set according to claim 1 wherein said tooling plate includes a tool attachment surface for attaching stamping and forming tooling thereto, and wherein said first coupling includes a linear bearing attached to said major mounting surface for each said at least two guide members, each said guide member in sliding engagement with a respective one of said linear bearings for permitting said reciprocating movement in a direction parallel to said major mounting surface.

3. The die set according to claim 2 wherein each said linear bearing includes inner and outer linear ball bearings spaced apart a first distance.

4. The die set according to claim 3 wherein each of said inner and outer linear ball bearings is secured in a respective inner and outer mounting block attached to said major mounting surface.

5. The die set according to claim 4 wherein each said guide member includes a compression spring encircling a portion thereof between respective said inner and outer mounting blocks, one end of said spring abutting a said inner mounting block and the other end of said spring coupled to said guide member by means of an adjustable coupling and arranged to exert a force thereto so that said tooling plate is urged in said reverse direction.

6. The die set according to claim 5 wherein said adjustable coupling includes screw threads attached to said guide member and a nut in threaded engagement with said screw threads and abutting said other end of said spring, wherein said force is varied by rotating said nut with respect to said screw threads.

7. The die set according to claim 6 wherein said screw threads comprise two semicircular portions coupled to said guide member between two shoulders.

8. The die set according to claim 6 wherein said nut comprises two semicircular portions coupled together by screws.

9. The die set according to claim 6 wherein said at least two guide members attached to and extending from opposite ends of said tooling plate comprise four guide members, two of which extend from one end of said tooling plate and the other two of which extend from an opposite end of said tooling plate.

10. The die set according to claim 6 wherein each said guide member is of generally cylindrical shape having a circular cross section.

11. A die set for use in a stamping and forming machine having a frame, a platen, and first and second rams extending through said platen and arranged to undergo reciprocating motion toward and away from each other, said die set comprising:

(1) a base plate having a major mounting surface and two spaced apart openings, said first ram extending through one said opening and said second ram extending through another said opening;

(2) first and second tooling plates for receiving and carrying stamping and forming tooling, said first and second tooling plates coupled to said major mounting surface by means of first and second couplings, respectively, so that said first and second tooling plates are free to undergo reciprocating movement toward and away from each other in forward and reverse directions parallel to and spaced from said major mounting surface and wherein each of said first and second couplings includes at least two guide members attached to and extending from opposite ends of said tooling plate from a side of said tooling plate opposite said tool attachment surface; and (3) third and fourth couplings, separate from said first and second couplings, arranged to couple said first and second rams to said first and second tooling plates, respectively, so that said rams impart said reciprocating movement to said tooling plates, wherein each of said third and fourth couplings is between two guide members of a respective said at least two guide members.

12. The die set according to claim 11 wherein each said tooling plate includes a tool attachment surface for attaching stamping and forming tooling thereto, and wherein each of said first and second couplings includes a linear bearing attached to said major mounting surface for each said at least two guide members, each said guide member in sliding engagement with a respective one of said linear bearings for permitting said reciprocating movement in a direction parallel to said major mounting surface.

13. The die set according to claim 12 wherein each said linear bearing includes inner and outer linear ball bearings spaced apart a first distance.

14. The die set according to claim 13 wherein each of said inner and outer linear ball bearings is secured in a respective inner and outer mounting block attached to said major mounting surface.

15. The die set according to claim 14 wherein each said guide member includes a compression spring encircling a portion thereof between respective said inner and outer mounting blocks, one end of said spring abutting a said inner mounting block and the other end of said spring coupled to said guide member by means of an adjustable coupling and arranged to exert a force thereto so that said tooling plate is urged in said reverse direction.

16. The die set according to claim 15 wherein said adjustable coupling includes screw threads attached to said guide member and a nut in threaded engagement with said screw threads and abutting said other end of said spring, wherein said force is varied by rotating said nut with respect to said screw threads.

17. The die set according to claim 16 wherein said screw threads comprise two semicircular portions coupled to said guide member between two shoulders.

18. The die set according to claim 16 wherein said nut comprises two semicircular portions coupled together by screws.

19. The die set according to claim 16 wherein said at least two guide members attached to and extending from opposite ends of each said tooling plate comprise four guide members, two of which extend from one end of each said tooling plate and the other two of which extend from an opposite end of each said tooling plate.

20. The die set according to claim 16 wherein each said guide member is of generally cylindrical shape having a circular cross section.

21. A die set for use in a stamping and forming machine comprising:

(1) a base plate having a major mounting surface;

(2) first and second tooling plates coupled to said major mounting surface by means of first and second couplings so that said first and second tooling plates are free to undergo reciprocating movement toward and away from each other in a direction parallel to and spaced from said major mounting surface, said first and second tooling plates each having tool attachment surfaces for attaching stamping and forming tooling thereto, and defining a volume of space extending between said two tool attaching surfaces, wherein said first and second couplings are disposed wholly outside of said volume of space, and wherein each of said first and second couplings comprises;

(1) at least two guide members attached to and extending from opposite ends of a respective said tooling plate from a side of said respective tooling plate opposite said tool attachment surface thereof;

(2) a linear bearing attached to said major mounting surface for each said at least two guide members, each said guide member in sliding engagement with a respective one of said linear bearings for permitting said reciprocating movement in a direction parallel to said major mounting surface.

22. The die set according to claim 21 wherein each said linear bearing includes inner and outer linear ball bearings spaced apart a first distance.

23. The die set according to claim 22 wherein each of said inner and outer linear ball bearings is secured in a respective inner and outer mounting block attached to said major mounting surface.

24. The die set according to claim 23 wherein each said guide member includes a compression spring encircling a portion thereof between respective said inner and outer mounting blocks, one end of said spring abutting a said inner mounting block and the other end of said spring coupled to said guide member by means of an adjustable coupling and arranged to exert a force thereto so that said tooling plate is urged in said reverse direction.

25. The die set according to claim 24 wherein said adjustable coupling includes screw threads attached to said guide member and a nut in threaded engagement with said screw threads and abutting said other end of said spring, wherein said force is varied by rotating said nut with respect to said screw threads.

26. The die set according to claim 25 wherein said screw threads comprise two semicircular portions coupled to said guide member between two shoulders.

27. The die set according to claim 25 wherein said nut comprises two semicircular portions coupled together by screws.

28. The die set according to claim 25 wherein said at least two guide members attached to and extending from opposite ends of each said tooling plate comprise four guide members, two of which extend from one end of each said tooling plate and the other two of which extend from an opposite end of each said tooling plate.

29. The die set according to claim 25 wherein each said guide member is of generally cylindrical shape having a circular cross section.

* * * * *